US008682650B2

(12) United States Patent
Gray et al.

(10) Patent No.: US 8,682,650 B2
(45) Date of Patent: Mar. 25, 2014

(54) SPEECH-QUALITY ASSESSMENT METHOD AND APPARATUS THAT IDENTIFIES PART OF A SIGNAL NOT GENERATED BY HUMAN TRACT

(75) Inventors: Philip Gray, Ipswich (GB); Michael P Hollier, St Martin (GB)

(73) Assignee: Psytechnics Limited (GB)

( * ) Notice: Subject to any disclaimer, the term of this patent is extended or adjusted under 35 U.S.C. 154(b) by 1809 days.

(21) Appl. No.: 11/321,045

(22) Filed: Dec. 30, 2005

(65) Prior Publication Data

US 2006/0224387 A1 Oct. 5, 2006

Related U.S. Application Data

(63) Continuation of application No. 10/110,100, filed as application No. PCT/GB00/04145 on Oct. 26, 2000, now abandoned.

(30) Foreign Application Priority Data

Nov. 8, 1999 (EP) ..... 99308858.2

(51) Int. Cl.
*G10L 25/00* (2013.01)
*G10L 25/30* (2013.01)
*G10L 25/75* (2013.01)

(52) U.S. Cl.
USPC ..... 704/200; 704/219; 379/1.02

(58) Field of Classification Search
CPC ..... G10L 25/00; G10L 25/30; G10L 25/75
USPC ..... 704/200.1, 200, 202, 203, 219; 379/1.02
See application file for complete search history.

(56) References Cited

U.S. PATENT DOCUMENTS 4,401,855 A 8/1983 Broderson et al.
5,940,792 A 8/1999 Hollier
6,119,083 A 9/2000 Hollier et al.

FOREIGN PATENT DOCUMENTS

WO WO97/05730 2/1997

OTHER PUBLICATIONS

Thomas W. Parsons, Voice and Speech Processing, "Analysis of the Cylindrical Model of the Vocal Tract," 1987, pp. 109 to 111.*
Ding et al., "Fast and robust joint estimation of vocal tract and voice source parameters," 1997 IEEE International Conference on Acoustics, Speech and Signal Processing, Apr. 21-24, 1997, vol. 2, pp. 1291-1294.
Lobo et al., "Evaluation of a glottal ARMA model of speech production," 1992 International Conference on Acoustics, Speech and Signal Processing, Mar. 23-26, 1992, vol. 2, pp. 13-16.
Berkeley, "Linear Prediction Analysis," 2 pgs.
-Msstate, "Lecture 16: Linear Prediction-Based Representations," 1 pg.

* cited by examiner

*Primary Examiner* — Martin Lerner
(74) *Attorney, Agent, or Firm* — Fenwick & West LLP

(57) ABSTRACT

Non-intrusive speech-quality assessment uses vocal-tract models, in particular for testing telecommunications systems and equipment. This process requires reduction of the speech stream under assessment into a set of parameters that are sensitive to the types of distortion to be assessed. Once parameterized, the data is used to generate a set of physiologically-based rules for error identification, using a parametric modeling of the shape of the vocal tract itself, by comparison between derived parameters and the output of models of physiologically realistic forms for the vocal tract, and the application of physical constraints on how these can change over time.

18 Claims, 4 Drawing Sheets

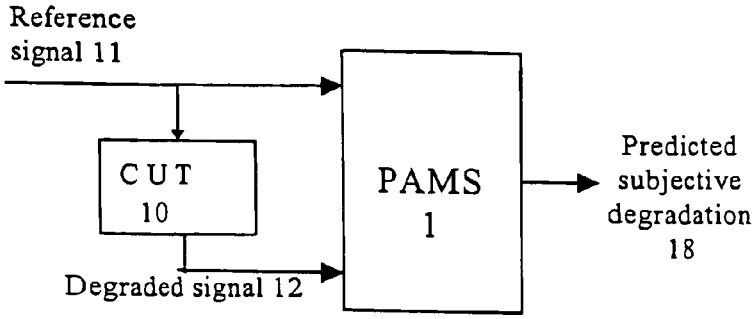
Figure 1
(PRIOR ART)
Figure 3
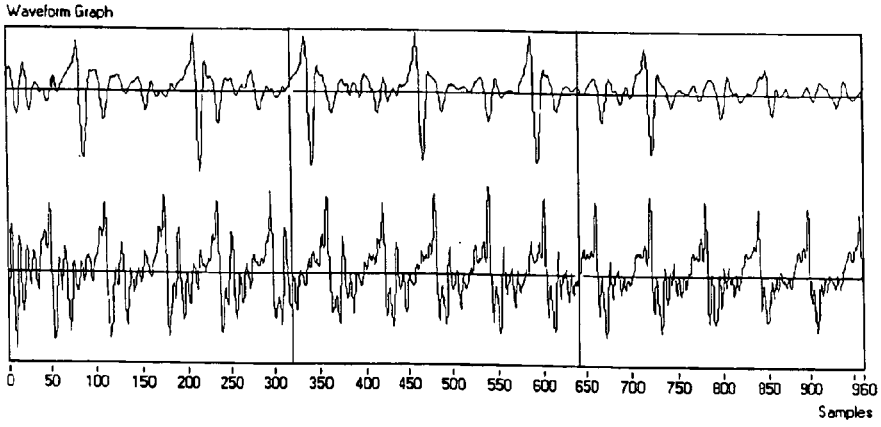
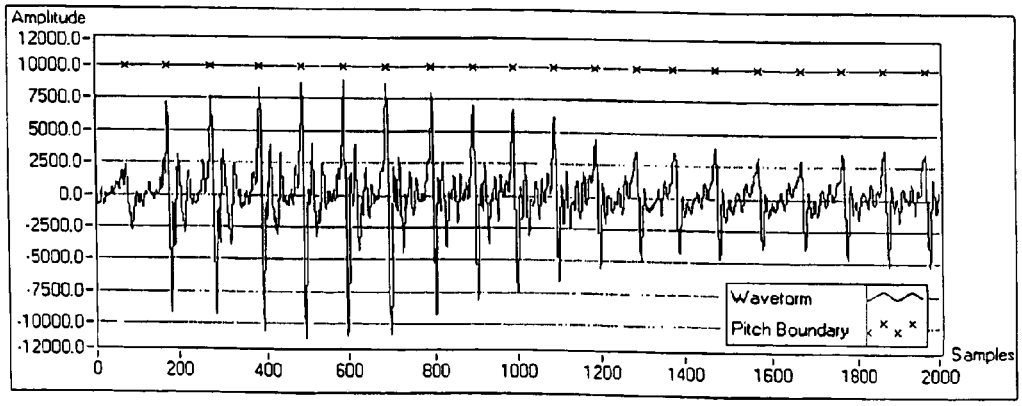
Figure 4

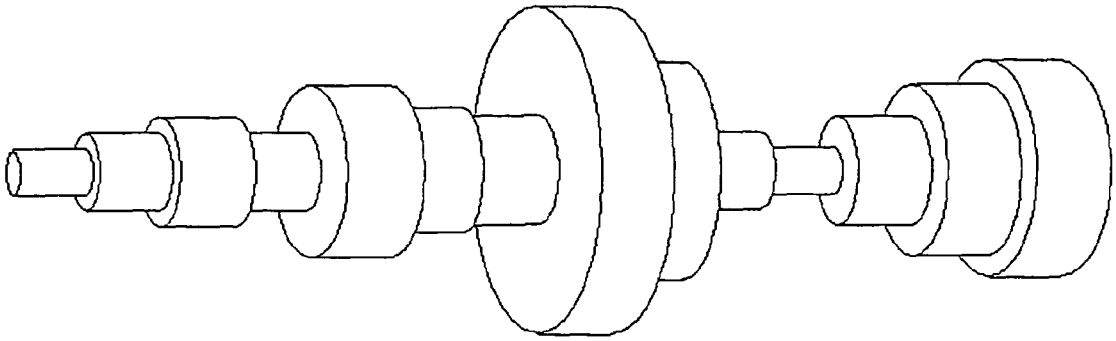
Figure 5
Figure 6
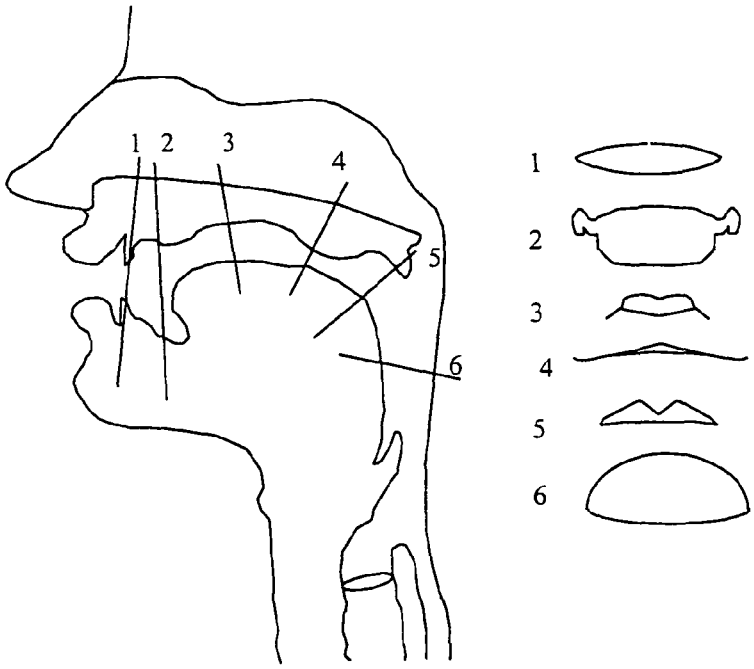

SPEECH-QUALITY ASSESSMENT METHOD AND APPARATUS THAT IDENTIFIES PART OF A SIGNAL NOT GENERATED BY HUMAN TRACT

CROSS-REFERENCES TO RELATED APPLICATIONS

This application is a continuation of U.S. application Ser. No. 10/110,100, filed Apr. 8, 2002, which is a National Phase of International Application No. PCT/GB00/04145, filed Oct. 26, 2000 which designated the U.S., the contents of which are incorporated herein.

BACKGROUND OF THE INVENTION

This invention relates to non-intrusive speech-quality assessment using vocal-tract models, in particular for testing telecommunications systems and equipment.

Customers are now able to choose a telecommunications service provider based upon price and quality of service. The decision is no longer fixed by monopolies or restricted by limited technology. A range of services is available with differing costs and quality of service. Service providers need the capability to predict customers' perceptions of quality so that networks can be optimized and maintained. Traditionally, networks have been characterized using linear assessment techniques, tone-based signals; and simple engineering metrics, such as signal-to-noise ratio. As networks become more complex, including non-linear elements such as echo cancellers and compressive speech coders, there is a requirement for assessment systems which bear a closer relationship to the human perception of signal quality. This role has typically been filled with expensive and time-consuming subjective tests using human subjects. Such tests are employed for commissioning new network elements, during the design of new coding algorithms, and for testing different network topologies.

Recent advances in perceptual modeling have led to the construction of objective auditory models, which can generate predictions of perceived telephony speech quality from a listener's perspective. These assessment techniques require a known test stimulus to excite a network connection and then use a perceptually-motivated comparison between a reference version of the known test stimulus, and a version of the same stimulus as degraded by the system under test, to provide a measure of the quality of the degraded version as it would be perceived by a human listener.

FIG. 1 shows the principle of the BT Laboratories Perceptual Analysis Measurement System (PAMS), disclosed in International Patent Applications W094/00922, W095/01011, and W095/15035. In this system the reference signal 11 comprises a speech-like test stimulus which is used to excite the connection under test 10 to generate a degraded signal 12. The two signals are then compared in the analysis process 1 to generate an output 18 indicative of the subjective impact of the degradation of the signal 12 when compared with the reference signal 11.

Such assessment techniques are known as "intrusive" because they require the withdrawal of the connection under test 10 from normal service so that it can be excited with a known test stimulus 11. Removing a connection from normal service renders it unavailable to customers and is expensive to the service provider. In addition, the conditions that generate distortions and errors could be due to network loading levels that are only present at peak times. An out-of-hours assessment could therefore generate artificial quality scores. This means that reliable intrusive testing is relatively expensive in terms of capacity on a customer's network connection.

In general, it would be preferable to continuously monitor the quality of speech at a particular point in the network. In this case, a "non-intrusive" solution is attractive, utilizing the in-service signal to make predictions of quality. Given this information, network traffic can be re-routed through less congested parts of the network if quality drops. A fundamentally different approach is required to analyse a degraded speech signal without a reference signal. The entire process takes place "downstream" of the equipment under test. Non-intrusive techniques are discussed in International Patent Specifications W096/06495 and W096/06496. Current non-intrusive assessment equipment performs measurements such as echo, delay, noise and loudness in an attempt to predict the clarity of a connection. However, a customer's perception of speech quality is also affected by distortions and irregularities in the speech structure, which are not described by such simple measures.

International Patent Specification W097/05730 (now also U.S. Pat. No. 6,035,270) describes a system of this general type which aims to generate an output indicative of how plausible it is that the passing audio stream was generated by the human vocal production system. This is achieved by comparing the audio stream with a spectral model representative of the sounds capable of production by the human vocal system. This process requires pattern recognition to distinguish the spectral characteristics representative of speech and of distortion, so that their presence can be identified.

These analysis processes use spectral models, although physiological models 30 have previously been used for speech synthesis—see for example the use of each types of model for these respective purposes in International patent specifications W096/06496 and W097/00432. Unlike a physiological model, spectral models are empirical, and have no intrinsic basis on which to identify what sounds the vocal tract is capable of producing. However, the physiological articulatory models used in the synthesis of continuous speech utilize constraints to ensure the generated speech is smooth and natural sounding. These models would therefore be unsuitable for an assessment process, since in such a process the parameters generated must also be capable of representing "illegal" vocal-tract shapes that the constraints used by such a synthesis model would ordinarily remove. It is the regions that are in error or distorted that contain the information for such an assessment; to remove this at the parameterization stage would make a subsequent analysis of their properties redundant.

BRIEF SUMMARY OF THE INVENTION

According to exemplary embodiments of the present invention, there is provided a method of identifying distortion in a signal carrying speech, in which the signal is analyzed according to parameters derived from a set of physiologically-based rules using a parametric model of the human vocal tract, to identify parts of the signal which could not have been generated by the human vocal tract. This differs from the prior art systems described above which use empirical spectral analysis rules to distinguish speech from other signals. The analysis process used in the invention instead considers whether physiological combinations exist that could generate a given sound, in order to determine whether that sound should be identified as possible to have been formed by a human vocal tract.

Preferably the analysis process comprises the step of reducing a speech stream into a set of parameters that are sensitive to the types of distortion to be assessed.

Cavity tracking techniques and context based error spotting may be used to identify signal errors. This allows both instantaneous abnormalities and sequential errors to be identified. Articulatory control parameters (parameters derived from the movement of the individual muscles which control the vocal tract) are extremely useful for speech synthesis applications where their direct relationships with the speech production system can be exploited. However, they are difficult to use for analysis, because the articulatory control parameters are heavily constrained to maintain their conformance to the production of real vocal tract configurations. It is therefore difficult to model error conditions, which necessarily require the modeling of conditions that the vocal tract cannot produce. It is therefore preferred to use acoustic tube models. Such models allow the derivation of vocal-tract descriptors directly from the speech waveform, which is attractive for the present analysis problem, as physiologically unlikely conditions are readily identifiable.

BRIEF DESCRIPTION OF THE DRAWINGS

An embodiment of the invention will now be described, with reference to the accompanying drawings, in which FIG. 1 is a schematic illustration of the PAMS intrusive assessment system already discussed.

FIG. 3 illustrates the use of a variable frame length.

FIG. 4 is an illustration of the pitch boundaries of a voiced speech event.

FIG. 5 illustrates a simplified uniform-cross-sectional-area tube model used in the invention.

FIG. 6 is an illustration of the human vocal tract.

Non-intrusive speech quality assessment processes require parameters with specific properties to be extracted from the speech stream. They should be sensitive to the types of distortions that occur in the network under test; they should be consistent across talkers; and they should not generate ambiguous mappings between speech events and parameters.

Figure 2:
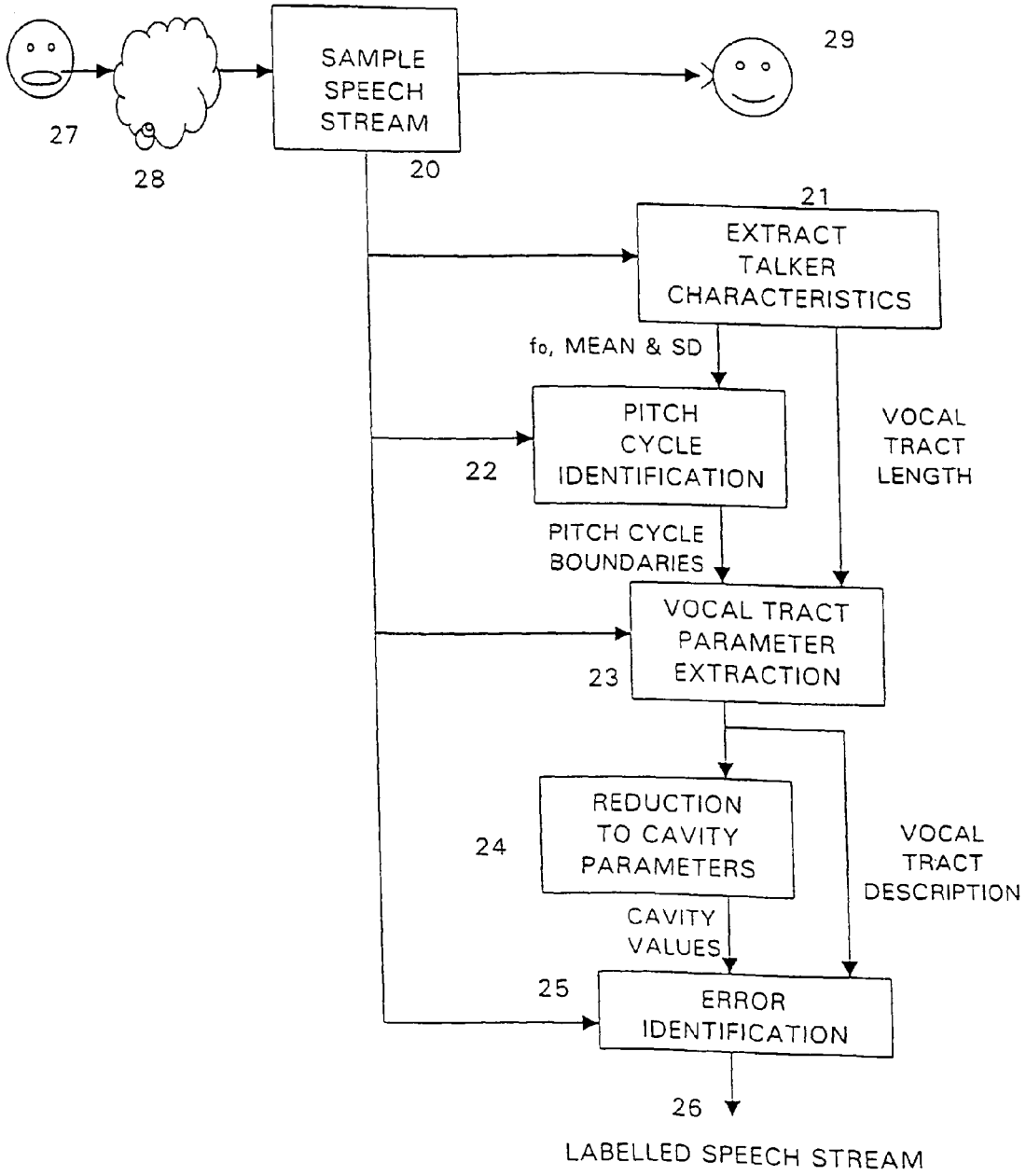
FIG. 2 is a schematic illustration of the system according to the invention.

FIG. 2 shows illustratively the steps carried out by the process of the invention. It will be understood that these may be carried out by software controlling a general-purpose computer. The signal 27 generated by a talker is degraded by the system 28 under test. It is sampled at point 20 and concurrently transmitted to the end user 29. The parameters and characteristics identified from the process are used to generate an output 26 indicative of the subjective impact of the degradation of the signal 27, compared with the signal assumed to have been supplied by the talker to the system 28 under test.

The degraded signal 27 is first sampled (step 20), and several individual processes are then carried out on the sampled signal.

DETAILED DESCRIPTION OF THE INVENTION

A major problem with non-intrusive speech-quality assessment is lack of information concerning talker characteristics. In the laboratory it is possible to generate talker-specific algorithms with near-perfect error spotting capabilities. These work well because prior knowledge of the talker has been used in development, even though no reference was used. In the real world operation with multiple talkers is necessary, and individual talker variation can generate significant performance reductions.

The process of the present invention compensates for this type of error by including talker characteristics in both the parameterization stage and also the assessment phase of the algorithm. The talker characteristics are restricted to those that can be derived from the speech waveform itself, but still yield performance improvements.

A model is used in which the overall shape of the human vocal tract is described for each pitch cycle. This approach assumes that the speech to be analyzed is voiced, (i.e. the vocal chords are vibrating, for example vowel sounds) so that the driving stimulus can be assumed to be impulsive. The vocal characteristics of the individual talker of signal 27 are first identified (process 21). These are features that are invariant for that talker of signal 27, such as the average fundamental frequency fo of the voice, which depends on the length of the vocal tract. This process 21 is carried out as follows. It uses a section of speech in the order of 10 seconds to characterize the talker by extracting information about the fundamental frequency and the third formant (third harmonic) values. These values are calculated for the voiced sections of speech only. The mean and standard deviation of the fundamental frequency is used later, during the pitch-cycle identification. The mean of the third formant values is used to estimate the length of the vocal tract.

The number of tubes used to calculate vocal tract, measured (as deviations from a notional figure of 17 cm) according to information from the formant positions within the speech waveform. Using the third formant, which is generally present with telephony bandwidth restrictions, it is possible to alter the number of tubes to populate the equivalent lossless tube model.

The appropriate number of tube sections is given by the closest integer value to $N_t$, where:

$$N_t=2lf_s/c$$

where: l=vocal tract length; $f_s$=sample frequency; c=speed of sound: (330 m/sec).

Assuming a sampling frequency of 16 kHz, for the average talker of vocal tract length 17 cm and average $3^{rd}$ formant frequency of 2500 Hz, this leads to sixteen cross-sectional areas being required to populate the tube model. Using a direct proportionality between the average $3^{rd}$ formant frequency for a talker and the length of the vocal tract it is possible to estimate the value of l in the equation above: this estimated value $l_m$ is calculated from:

$$l_m/17=2500/d$$

where d, average $3^{rd}$ formant value.

For a female talker with an average third formant frequency of 3 kHz, this gives an estimated vocal tract length of 14 cm, and the number of tube sections $N_t$ as fourteen. This method for vocal tract length normalization reduces the variation in the parameters extracted from the speech stream so that a general set of error identification rules can be used which are not affected by variations between talker, of which pitch is the main concern.

Once characterization has been carried out using the initial ten second section of speech, the parameters identified (mean fundamental frequency, standard deviation, and vocal tract length) may be used for the rest of the speech stream, periodically repeating the initial process in order to detect changes in the talker of signal 27.

The samples taken from the signal 27 (step 20) are next used to generate speech parameters from these characteristics. An initial stage of pitch synchronization is carried out (step 22). This stage generates a pitch-labeled speech stream, enabling the extraction of parameters from the voiced sections of speech on a variable time base. This allows synchronization with the speech waveform production system, namely the human speech organs, allowing parameters to be derived from whole pitch-periods. This is achieved by selecting the number of samples in each frame such that the frame length corresponds with a cycle of the talker's speech, as shown in FIG. 3. Thus, if the talker's speech rises and falls in pitch the frame length will track it. This reduces the dependence of the parameterization on gross physical talker properties such as their average fundamental frequency. Note that the actual sampling rate carried out in the sampling step 20 remains constant at 16 kHz—it is the number of such samples going to make up each frame which is varied.

Various methods exist for the generation of pitch-synchronous boundaries for parameterization. The present embodiment uses a hybrid temporal spectral method, as described by the inventors in their paper "*Constraint-based pitch-cycle identification using a hybrid temporal spectral method*"—105$^{th}$ *AES Convention,* 1998. This process uses the mean fundamental frequency $f_0$, and the standard deviation of this value, to constrain the search for these boundaries.

The output of this non-real time method can be seen in FIG. 4, which shows the pitch boundaries (marked "X") for a voiced speech event. It can be seen that these are synchronized with the largest peaks in the voice signal, and thus occur at the same frequency as the fundamental frequency of the talker's voice. The lengths of the pitch cycles vary to track changes in the pitch of the talker's voice.

Having identified the pitch-synchronous parameters, the parameterization of the vocal tract can now be done (step 23). It is important that no constraints are imposed during the parameterization stages that could smooth out or remove signal errors, as they would then not be available for identification in the error identification stage. Articulatory models used in the synthesis of continuous speech utilize constraints to ensure the generated speech is smooth and natural sounding. The parameters generated by a non-intrusive assessment must be capable of representing illegal vocal-tract shapes that would ordinarily be removed by constraints if a synthesis model were used. It is the regions that are in error or distorted that contain the information for such an assessment, to remove this at the parameterization stage would make a subsequent analysis of their properties redundant.

In the process of the present embodiment, reflection coefficients are first calculated directly from the speech waveform over the period of a pitch cycle, and these are used to determine the magnitude of each change in cross section area of the vocal tract model, using the number of individual tube elements derived from the talker characteristics already derived (step 21). The diameters of the tubes to be used in the model can then be derived from these boundary conditions (step 23). An illustration of this representation can be seen in FIG. 5, which shows a simplified uniform-cross-sectional-area model of a vocal tract. In this model the vocal tract is modeled as a series of cylindrical tubes having uniform length, and having individual cross sectional areas selected to correspond with the various parts of the vocal tract. The number of such tubes was determined in the preliminary step 21.

For comparison, the true shape of the human vocal tract is illustrated in FIG. 6. In the left part of FIG. 6 there is shown a cross section of a side view of the lower head and throat, with six section lines numbered 1 to 6. In the right part of FIG. 6 are shown the views taken on these section lines. The non-circular shape of the real vocal tract, and the fact that the real transitions are not abrupt steps result in higher harmonics being modeled less well in the tube model of FIG. 5, but these do not affect the analysis for present purposes. We can therefore use a uniform-cross-sectional-area tube model to describe the instantaneous state of the vocal tract.

Certain errors may be apparent from the individual vocal tract parameters themselves, and can be identified directly. However, more generalized error indentification rules may be derived from parameters derived by aggregating these terms. For this reason, dimensionality of the vocal-tract description is reduced even further at this point to maintain a constant number (step 24). Methods that track constrictions within the tract yield large variations in the individual cavity parameters during steady-state clean speech attributable to minor differences in the calculation of the constriction point. These differences are significant enough to mask certain errors in degraded speech streams.

It has been found experimentally that the best results are produced by splitting the tract into three regions: front cavity, rear cavity, and jaw opening. The accompanying table shows the number of tube elements making up each of the three cavities for each of the numbers of tubes considered.

| Total Number of Tubes | Rear Cavity | Front Cavity | Jaw Opening |
|---|---|---|---|
| 12 | 5 | 5 | 2 |
| 13 | 5 | 6 | 2 |
| 14 | 6 | 5 | 3 |
| 15 | 6 | 6 | 3 |
| 16 | 7 | 6 | 3 |
| 17 | 7 | 7 | 3 |
| 18 | 8 | 7 | 3 |

The total cross sectional area in each of the tube subsets is aggregated to give an indication of cavity opening in each case.

Figure 7:
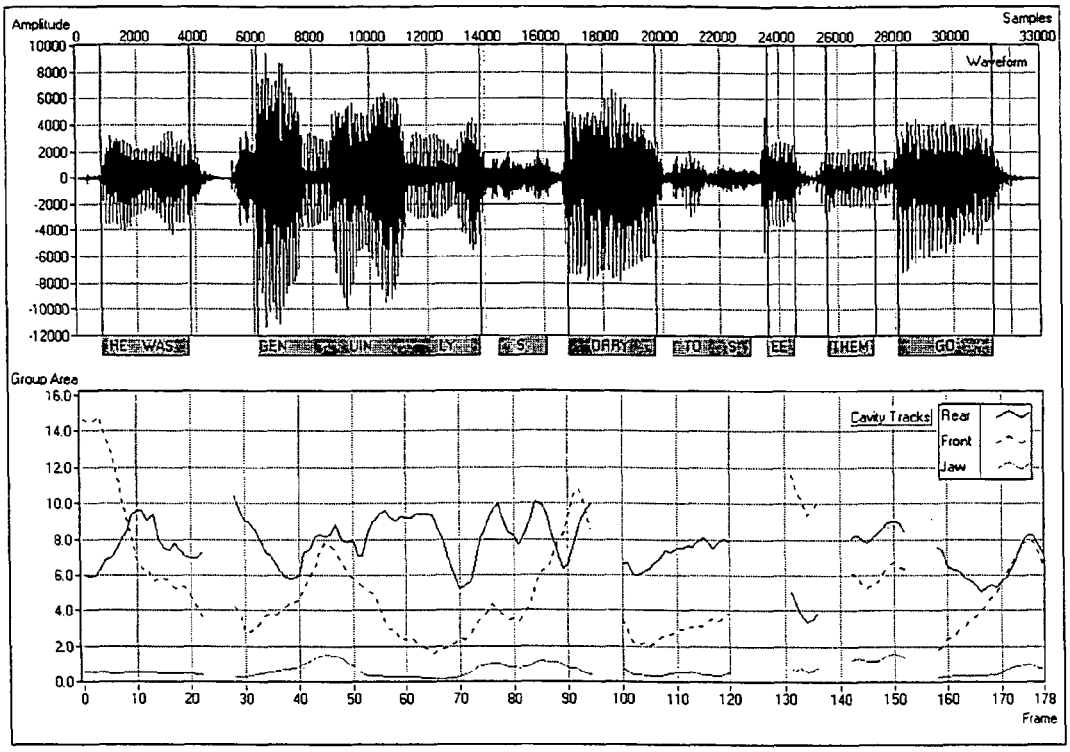
FIG. 7 illustrates a cavity area sequence.

Examples of cavity traces can be seen in FIG. 7, showing (in the lower part of the figure) the variation in area in each of the three defined cavities during the passage of speech "He was genuinely sorry to see them go", whose analogue representation is indicated in the part of the Figure. The blank sections correspond to unvoiced sounds and silences, which are not modeled using this system. This is because the cross sectional area parameters can only be calculated during a pitched voice event, such as those which involve glottal excitation caused by vibration of the vocal chords. Under these conditions parameters can be extracted from the speech waveform which describes its state. The rest of the events are unvoiced and are caused by constrictions at different places in the tract causing turbulent airflow, or even a complete closure. The state of the articulators is not so easy to estimate for such events.

The cavity sizes extracted (step 24) from the vocal tract parameters for each pitch frame are next assessed for physiological violations (step 25). Any such violations are taken to be caused by degradation of the signal 27, and cause an error to be identified. These errors are identified in the output 26. Errors can be categorized in two major classes, instantaneous and sequential.

Instantaneous errors are identified where the size of the cavity value at a given instance in time is assessed as implying a shape that would be impossible for a human vocal tract to take. An extreme example of this is that certain signal distortions can yield excessively large apparent jaw openings—for example 30 cm, and could not have been produced by a human vocal tract. There are other more subtle situations, which have been found empirically, where certain combinations of cavity sizes do not occur in human speech. Any such physiological impossibilities are labeled accordingly, as being indicative of a signal distortion.

One of the most common areas of degradation in speech streams in the modern telephony network is through speech coding. Specialized coding schemes, specific to voice signals, can generate distortions when incorrect outputs are generated from the coded parameter stream. In this situation the individual frames may seem entirely appropriate when viewed in isolation, but when the properties of the adjacent frames are taken into account, an error in the degraded signal is apparent. These types of distortion have been termed "sequential errors". Sequential errors occur quite often in heavily coded speech streams. If incorrect parameters arrive at the decoder, because of miscoding or corruption during transmission, the reconstructed speech stream may contain a spurious speech event. This event may be "legal"—that is, if viewed in isolation or over a short time period it does not require a physiologically impossible instantaneous configuration of the vocal tract—but when heard would be an obvious that an error was present. These types of distortion are identified in the error identification step by assessing the sizes of cavities and vocal tract parameters, in conjunction with the values for preceding and subsequent frames, to identify sequences of cavity sizes which are indicative of signal distortion.

The error identification process 25 operates according to predetermined rules arranged to identify individual cavity values, or sequences of such values, which cannot occur physiologically. Some speech events are capable of generation by more than configuration of the vocal tract. This may result in apparent sequential errors when the process responds to a sequence including such an event, if the process selects a vocal tract configuration different from that actually used by the talker. The process is arranged to identify any apparent sequential errors which could result from such ambiguities, so that it can avoid mislabeling them as errors.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A computer implemented method for identifying distortion in a signal carrying speech, said method comprising:

analyzing a signal, using at least one computer, according to parameters derived from a set of physiologically-based rules using a parametric model of the human vocal tract that involves a plurality of physiologies of the human vocal tract; and identifying parts of the signal which could not have been generated by the human vocal tract based on said analysis.

2. A method according to claim 1, in which the analysis of the signal comprises identification of the instantaneous configuration of the parametric model.

3. A method according to claim 1 in which the analysis of the signal comprises the analysis of sequences of configurations of the parametric model.

4. A method according to claim 1, in which cavity tracking and context based error spotting are used to identify signal errors.

5. A method according to claim 4, in which the parametric model comprises a series of cylindrical tubes, the dimensions of the tubes being derived from reflection coefficients determined from analysis of the original signal.

6. A method according to claim 5, wherein the number of tubes in the series is determined from a preliminary analysis of the signal to identify vocal characteristics characteristic of the talker generating the signal.

7. A method according to claim 1, in which pitch-synchronized frames are selected for analysis.

8. Apparatus for assessing the quality of a signal carrying speech, comprising processing means for performing the method of claim 1.

9. A data carrier carrying program data for programming a computer to perform the method of claim 1.

10. A method according to claim 1, wherein the plurality of physiologies of the human vocal tract include front cavity, rear cavity and jaw opening.

11. Apparatus for assessing the quality of a signal carrying speech, said apparatus comprising:

means for deriving parameters of a signal from a set of physiologically-based rules using a parametric model of the human vocal tract that involves a plurality of physiologies of the human vocal tract, and means for identifying parameters which indicate whether the signal could have been generated by the human vocal tract.

12. Apparatus according to claim 11, comprising means for identification of the instantaneous configuration of the parametric model.

13. Apparatus according to claim 11 comprising means for analysis of sequences of configurations of the parametric model.

14. Apparatus method according to claim 11, wherein the parameter-deriving means include cavity tracking means and context based error spotting means.

15. Apparatus according to claim 14, comprising means for analysis of the original signal to identify reflection coefficients, and model generation means for generation of a parametric model comprising a series of cylindrical tubes, the dimensions of the tubes being derived from the reflection coefficients.

16. Apparatus according to claim 15, comprising means for making a preliminary analysis of the signal to identify vocal characteristics characteristic of the talker generating the signal, and wherein the parameteric model generation means is arranged to select the number of tubes in the series according to the said vocal characteristics.

17. Apparatus method according to claim 11, in which the analysis means is arranged to select pitch-synchronized frames.

18. Apparatus according to claim 11, wherein the plurality of physiologies of the human vocal tract include front cavity, rear cavity and jaw opening.

* * * * *